US010132581B2

(12) United States Patent
Chachamian et al.

(10) Patent No.: US 10,132,581 B2
(45) Date of Patent: Nov. 20, 2018

(54) BELT/METALLIC LINK CHAIN LOADED AMMUNITION FEEDER IN A REMOTE CONTROLLED WEAPON STATION

(71) Applicant: RAFAEL ADVANCED DEFENSE SYSTEMS LTD., Haifa (IL)

(72) Inventors: Shimon Chachamian, Haifa (IL); Ran Hamish, Hanaton (IL)

(73) Assignee: Rafael Advanced Defense Systems, Ltd., Haifa (IL)

( * ) Notice: Subject to any disclaimer, the term of this patent is extended or adjusted under 35 U.S.C. 154(b) by 573 days.

(21) Appl. No.: 14/406,077

(22) PCT Filed: Jun. 3, 2013

(86) PCT No.: PCT/IL2013/050474
§ 371 (c)(1),
(2) Date: Dec. 5, 2014

(87) PCT Pub. No.: WO2013/183046
PCT Pub. Date: Dec. 12, 2013

(65) Prior Publication Data

US 2015/0153123 A1 Jun. 4, 2015

(30) Foreign Application Priority Data

Jun. 5, 2012 (IL) ..... 220182

(51) Int. Cl.
*F41A 9/32* (2006.01)
*F41A 9/34* (2006.01)
(Continued)

(52) U.S. Cl.
CPC ..... *F41A 9/32* (2013.01); *F41A 9/34* (2013.01); *F41A 9/38* (2013.01); *F41A 27/00* (2013.01); *F41A 27/24* (2013.01)

(58) Field of Classification Search
CPC ..... F41A 23/24; F41A 27/18; F41A 27/00; F41A 27/06; F41A 27/24; F41A 9/00; F41A 9/29; F41A 9/32; F41A 9/34; F41A 9/38
See application file for complete search history.

(56) References Cited

U.S. PATENT DOCUMENTS 2,378,191 A 6/1945 Corte
3,333,507 A 8/1967 De Meiss
(Continued)

FOREIGN PATENT DOCUMENTS

EP 0491271 6/1992
ES 2297815 5/2008
(Continued)

*Primary Examiner* — Benjamin P Lee
(74) *Attorney, Agent, or Firm* — Rodney J. Fuller; Booth Udall Fuller, PLC

(57) ABSTRACT

Belt/Metallic Link Chain Loaded Ammunition Feeder in a Remote Controlled Weapon Station (RCWS). The feeder includes a feeding mechanism for routing chained ammunition from ammunition reservoir means towards the weapon's bullets entrance opening. The feeding mechanism has a first chute assembly for routing chained ammunition from the ammunition reservoir means towards the region of the RCWS's elevating/lowering axis, and a second chute assembly for continuing routing the chained ammunition from the region of the elevating/lowering axis towards the entry opening of the bullets entrance of the weapon. The chained ammunition traverses over the elevating/lowering axis region by passing from the first chute assembly to the second chute assembly. The first chute assembly remains static and the second chute assembly is dynamic and propelled together with the mounting bracket assembly around the elevating/lowering axis.

2 Claims, 8 Drawing Sheets

(51) Int. Cl.

| | |
|---|---|
| ***F41A 9/38*** | (2006.01) |
| ***F41A 27/00*** | (2006.01) |
| ***F41A 27/24*** | (2006.01) |

(56) References Cited

U.S. PATENT DOCUMENTS

| | | | | |
|---|---|---|---|---|
| 4,574,683 | A * | 3/1986 | LeBlanc | F41A 9/54 89/33.04 |
| 5,782,157 | A * | 7/1998 | Ellington | F41A 9/29 193/25 AC |
| 2007/0119296 | A1* | 5/2007 | Niv | F41A 23/20 89/37.02 |
| 2016/0025435 | A1* | 1/2016 | Lung | F41A 9/29 89/37.15 |

FOREIGN PATENT DOCUMENTS

| | | | | |
|---|---|---|---|---|
| ES | 2337493 | | 4/2010 | |
| GB | 2149069 | A * | 6/1985 | B64D 7/06 |
| WO | 2009030385 | | 3/2009 | |
| WO | WO 2015118247 | A1 * | 8/2015 | F41A 9/34 |

* cited by examiner

BELT/METALLIC LINK CHAIN LOADED AMMUNITION FEEDER IN A REMOTE CONTROLLED WEAPON STATION

RELATED APPLICATION DATA

This application is the U.S. National Stage of International Application No. PCT/IL2013/050474, filed Jun. 3, 2013, which claims the benefit of and priority to Israeli Patent Application No. 220182, filed Jun. 5, 2012. Each of the foregoing applications is hereby incorporated by reference in its entirety for all purposes.

FIELD OF THE INVENTION

The invention, the subject matter of this patent application, is in the field of Remote Controlled Weapon Stations (herein after—RCWS) and especially in the field of feeding ammunition that is loaded in a metallic link chain/belt to weapons such as machine guns, automatic 20-40 mm caliber cannon, grenades' machine gun, that are liable to be mounted in the RCWS.

BACKGROUND OF THE INVENTION

Remote Controlled Weapon Station—RCWS, constitutes a weapon station that is generally mounted on army vehicles or on armored combat vehicles and controlled from the inside by means of a joystick, video display and an operating console. The RCWS comprises all the functions which enable it to acquire targets, aim the weapon and fire at a target with high accuracy. The gunner operates while he is within the vehicle and is protected by the vehicles' armor.

As an example and for providing explanations (clarifications), reference is being made to FIG. 1. The figure shows a representative example of RCWS 10, viewed in perspective, in a manner that one can learn about the relative movement that takes place between its various components. RCWS 10 is assembled from two assemblies that are movable one in relation to the other.

One (First) assembly is weapon mounting bracket 20 that is suited to being mounted with a weapon 30, one or more, that is fed with ammunition loaded in a metallic link chain (belt) (herein after "chained ammunition"). In the illustrated example, a Browning M2 machine gun is depicted, but any professional would understand that in the RCWS might be mounted other and different weapons (such as other types of machine guns, automatic 20-40 mm cannons, grenades machine guns. Weapon mounting bracket 20 is movable in the elevating/lowering plane, a movement that is pivotally executed around axis 50 that by itself is usually positioned perpendicular to firing axis 60 of the weapon (the lengthwise axis of the weapon's barrel).

Mounting bracket 20 is mounted on the second assembly—a rotatable turret assembly 70. Rotatable turret assembly 70 is suited to be mounted, for example, on a vehicle's platform (that is not illustrated) from within it the RCWS is operated. Rotatable turret assembly 70 is movable in the rotation (siding or bearing) plane 80, a movement executed around axis 90 (the axis that is perpendicular to the bearing component of the rotatable turret assembly in the RCWS, and passes in its center).

Thus, in this manner combined capabilities of full circle bearings (360°) and elevating/lowering (for example in the range between elevating of up to +60° and lowering to −20° of weapon's 30 barrel, that are relatively accurate (are obtained (achieved) by an array of controlled servo motors)).

Weapon 30 needs running supply of ammunition that is given in metallic link chain/belt (chained ammunition). In the period that preceded the invention, the subject matter of this application, there existed two principal methods of feeding chained ammunition to such a weapon when it is mounted in an RCWS.

Reference is being made to FIG. 2, that presents in a schematic manner the first method—box 205 containing an ammunition chain, is practically affixed to mounting bracket 20, and travels (moves) dynamically with it, in the elevating/lowering plane 40, around axis 50. In consequence, the required movement path for the ammunition chain, from the ammunition box (reservoir) towards the bullets (cartridges) entrance opening to the weapon, is not influenced by the rotational and elevating/lowering motions of the weapon in the RCWS, the ammunition reservoir (box) swings and revolves around axis 50 in a dynamic manner, together with the weapon and in relatively close proximity to it.

This method has several disadvantages—the amount of bullets in the box might be limited (as per volume and weight limits) and the gradual emptying of the box as long as firing continues requires changes in the dynamic balancing of mounting bracket 20 (the control requirements are stiff due to the dynamic variation in the box weight, and in consequence reducing the weight and the inertia that are exerted on the axis).

Reference is being made to FIG. 3, which presents in a schematic manner the second method—box 305 and in it the ammunition chain, are actually rigidly affixed to rotatable turret assembly 70 and transported with it only in the rotation (siding or bearing) plane 80, around axis 90.

Actually, this method is a solution to the disadvantages we pointed at above while referring to the first method (FIG. 2)—the amount of ammunition in the box can be large and the gradual emptying of the box does not necessitates varying the balancing of mounting bracket 20. However, due to positioning the box as disconnected from the mounting bracket—the required movement path for the ammunition chain, from the box to the bullets (cartridges) entrance opening to the weapon is influenced by the elevating/lowering of the weapon in the RCWS.

From the beginning, the will to instill to the weapon in the RCWS a large angular range from the elevating/lowering aspect, leads to positioning axis 50 at a substantial large distance (see FIG. 3, dimension H1) away from (siding or bearing) rotation plane 80 (on it, as said, the ammunition box is positioned) and in a manner that mandates at times a relatively long moving distance of the chain (and obviously presents a not so negligent pulling challenge to the weapons, in a manner that mandates sometimes resorting to assistance by propelling means that force the chain to move towards the bullets (cartridges) entrance opening of the weapon).

But in addition, as said, the elevating/lowering movements of the weapon influence the chain's movement path in the angular dimension and in the height dimension that is shortened (see ibid H0) and gets longer (ibid H1), in accordance with the elevating/lowering movements (at least, as much as the bullets entrance opening of the weapon is located as it is shifted from axis 50 (ibid distance L). As a result, the bullets chain is required to adjust itself to the geometrical changes (to become shorter and longer) and surplus (bullets) can be accumulating that causes stoppages.

Solutions to the problems that are known in field, include for example, manufacturing the chains proper in a multi joints vertebral configuration that enables not only absorbing the angular changes as said, to which it is exposed, but also its getting shorter/longer. Another example—routing the bullets chain inside a feeding mechanism of the 'flexible chute' type that connects between the ammunition box and the bullets entrance opening of the weapon. These two solutions were found to be relatively expensive and sensitive to failures (for example feeding failures, creation of stoppages).

Thus in the period before this invention, there existed in the RCWS field, a need to provide a reliable and relatively low-cost solution to the challenge of feeding chained ammunition bullets to the bullets entrance opening of the weapon that is mounted in the mounting bracket and without giving up the advantages of high volume of ammunition reservoir and the lack of need for dynamic balancing of the mounting bracket in correlation with the ammunition reservoir emptying, as those advantages are already provided in accordance with the second method (FIG. 3).

SUMMARY OF THE INVENTION

The invention, the subject matter of this patent application responds to the need that we pointed at above, by providing a mechanism in an RCWS that enables chained ammunition feeding from an ammunition reservoir (for example—a box) that is located at the rotation (bearing or siding) plane, towards the weapon's bullets entrance opening, without having to resort to a flexible chute assembly and while preventing exceptional forcing of the chain to get shortened/lengthened in spite of elevating/lowering of the weapon.

In one aspect, the invention is an RCWS that comprises as usual—a mounting bracket assembly 20 that is suited to be mounted with a weapon that is fed by chained ammunition, a rotatable turret assembly wherein the mounting bracket is mounted on it in a manner that enables elevating/lowering of the weapon around an elevating/lowering axis, and wherein the rotatable turret assembly enables bearing (siding) of the mounting bracket assembly in a rotation bearing plane that is positioned at a distance from the elevating/lowering axis and parallel to it, around a rotation (bearing) axis that extends vertically to the rotation (bearing), and chained ammunition reservoir means for the weapon that is mounted in the rotation (bearing) plane and in a distance from the elevating/lowering axis (apparently, in accordance with the second method that we pointed at in the 'Background of the Invention' chapter while referring to FIG. 3).

The point of novelty of an RCWS in accordance with the invention is embodied in the feeding mechanism for routing (guiding) chained ammunition from the ammunition reservoir means unto the bullets entrance opening of the weapon. In accordance with the invention, the feeding mechanism comprises first chute assembly for guiding chained ammunition from the ammunition reservoir means towards the elevating/lowering axis region, wherein the first chute is mounted on the rotatable turret assembly, and second chute assembly for continuing routing the chained ammunition from the elevating/lowering axis region unto the entry opening of the bullets entrance of the weapon, wherein the second chute is mounted on the weapon mounting bracket.

In accordance with the invention, the passage of the chained ammunition over the elevating/lowering axis region, on its passage from the first chute to the second chute occurs when the ammunition is adjusted (directed) in an orientation that is at least substantially matching to the elevating/lowering axis direction, and when the mounting bracket is driven to a elevating/lowering movement around the elevating/lowering axis, the first chute remains static while the second chute is dynamic and pivotally moving with the mounting bracket around the elevating/lowering axis.

In another and an additional aspect of the invention, a general method is embodied in it, for feeding chained ammunition in the RCWS to a weapon that has rotating (bearing or siding) capability around an axis perpendicular to the bearing plane and elevating/lowering ability of the weapon around elevating/lowering axis that extends in parallel to the bearing plane and located at a distance from it. The method includes a step of pulling chained ammunition from ammunition reservoir means that is mounted on the bearing plane and routing it towards the entry opening of the bullets to the weapon (on the face of it, in accordance with the second method that we pointed at in the 'Background of the Invention' chapter while referring to FIG. 3).

The point of novelty of the method aspect that is embodied in the invention, is found in that that during the step of pulling the chained ammunition, the method comprises the steps of— a. Routing the chained ammunition towards the region of the elevating/lowering axis by the first chute assembly; and
b. Routing the chained ammunition from the elevating/lowering plane axis region towards the entry opening of the weapons bullets entrance: and
c. Directing the ammunition in an orientation that it would be at least substantially matching the direction of the elevating/lowering axis, at the time that the chained ammunition passes over the elevating/lowering axis region, upon it passage from the first chute assembly to the second chute assembly; and in a manner that enables parallel existence of elevating/lowering of the weapon in a motion around the elevating/lowering axis together with said second chute while the first chute remains static.

It is to be understood that both the foregoing general description and the following detailed description are exemplary and explanatory and are intended to provide further explanations of the invention as claimed.

BRIEF DESCRIPTION OF THE ACCOMPANYING FIGURES

Examples illustrative of embodiments of the invention are described below with reference to figures attached hereto. In the figures, identical structures, elements or parts that appear in more than one figure are generally labeled with the same numeral in all the figures in which they appear. Dimensions of components and features shown in the figures are generally chosen for convenience and clarity of presentation and are not necessarily shown to scale.

DETAILED DESCRIPTION OF AN EXAMPLE CONFIGURATION OF THE INVENTION

Figure 4:
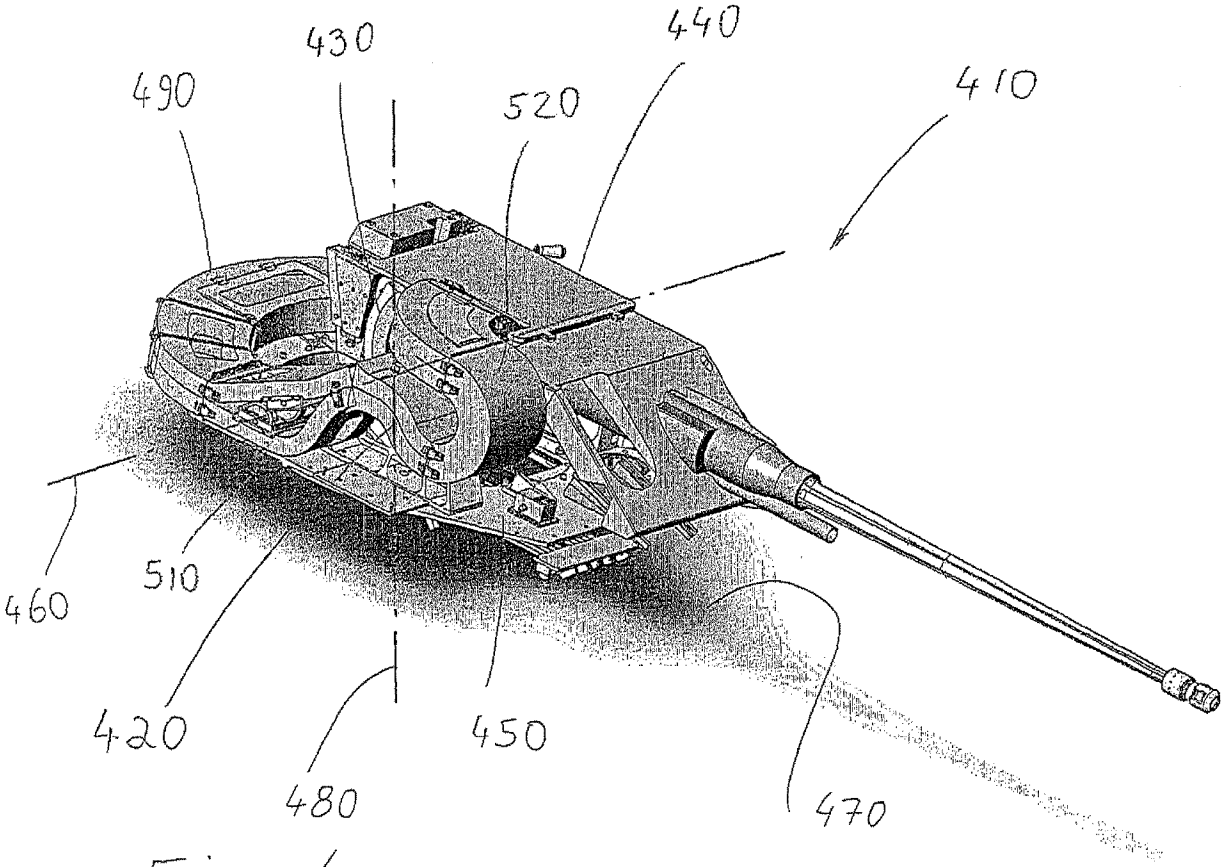
FIG. 4 is a view in perspective of an example RCWS wherein a feeding mechanism in accordance with the invention is implemented.
Figure 5:
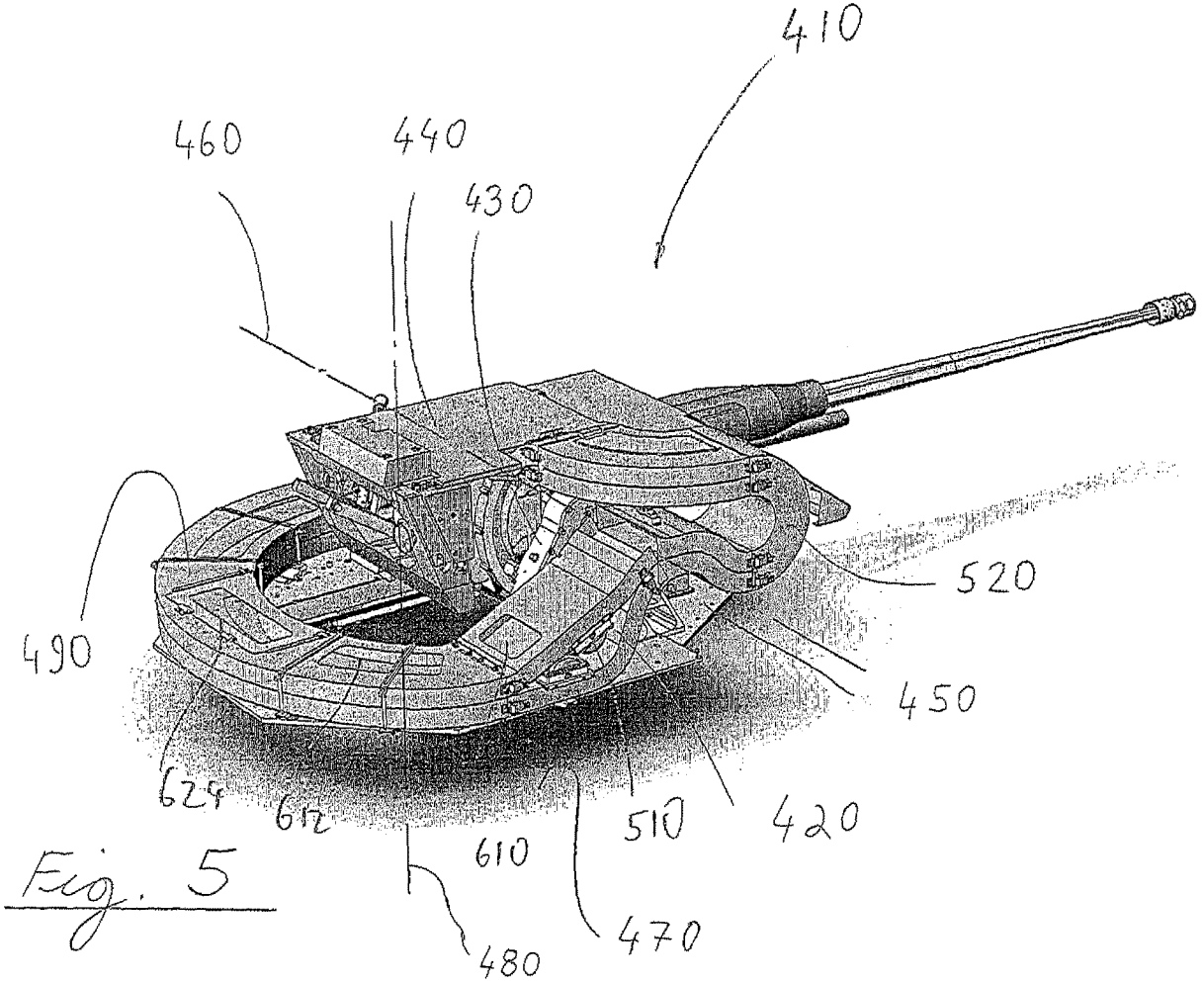
FIG. 5 is a view in perspective from another angle of the RCWS that was illustrated in FIG. 4.
Figure 6:
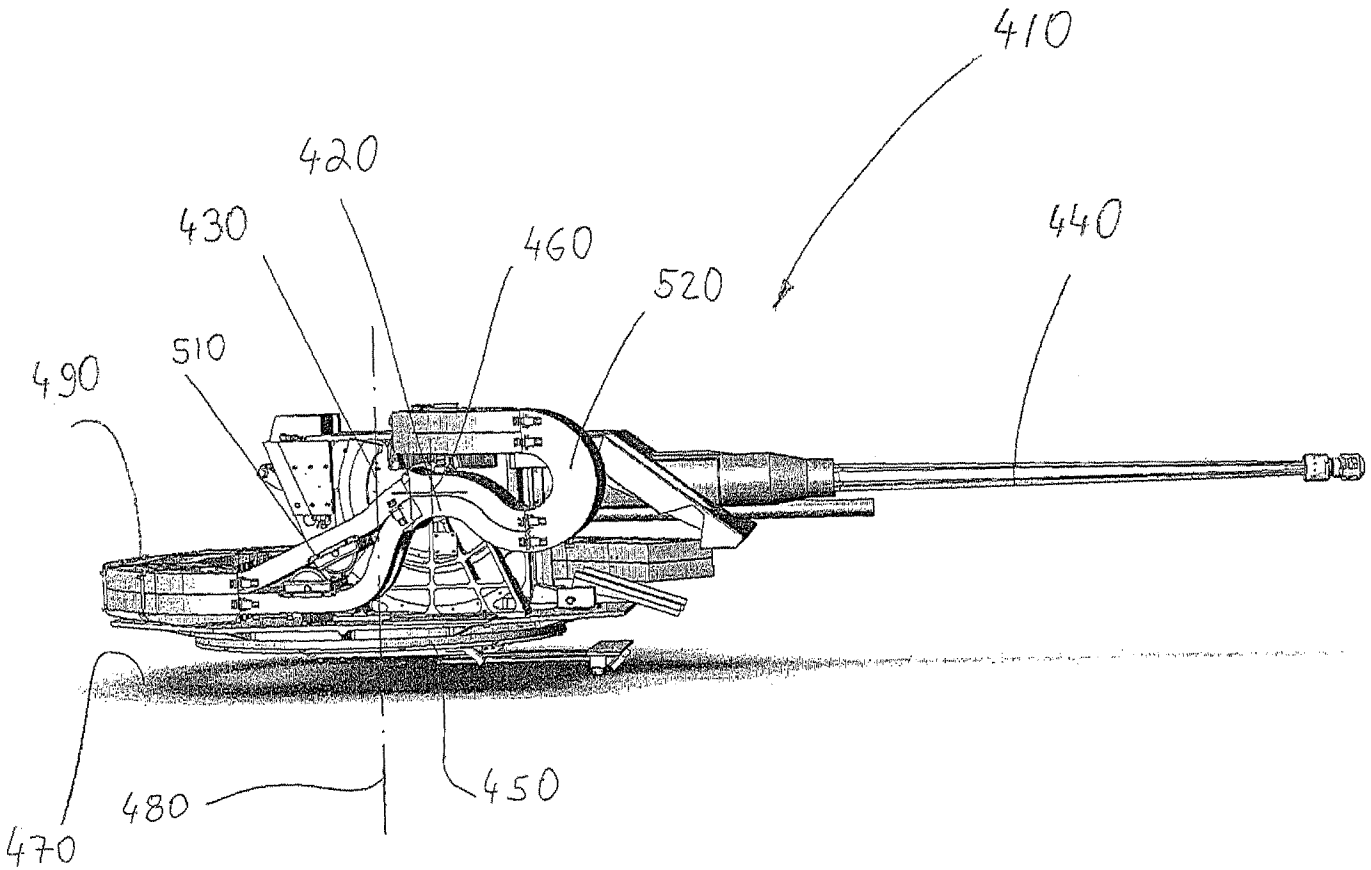
FIG. 6 is a side view in perspective of the RCWS that was illustrated in FIGS. 4 and 5.

Reference is being made to FIGS. 4 to 6. FIG. 4 is a view in perspective of an example of an RCWS in accordance with the invention, RCWS 410 wherein a feeding mechanism 420 is implemented. FIG. 5 is a view in perspective from another angle of RCWS 410. FIG. 6 is a side view of RCWS 410.

RCWS 410 comprises mounting bracket assembly 430 that in the illustrated example is mounted on it a caliber 30 mm automatic cannon 440 (in the illustrated example—Mk 44 Bushmaster). Namely—on mounting bracket assembly 430 a weapon fed by chained ammunition is mounted. Moreover, in the illustrated example, it is spoken of a weapon (Mk 44 Bushmaster) that has dual feed. It is possible to feed it alternatively by two chains that are routed in parallel to the bullets (shells) entrance opening of the weapon (for example—in each one of them a different kind of ammunition is loaded; for example—in one chain High Explosive ammunition and in the other chain Armor Piercing type of ammunition).

A skilled professional would understand that it is mentioned solely of an example, and that on mounting bracket assembly 430 of RCWS 410, other kind of weapon that is chain fed can be mounted. For example—machine gun, automatic cannon with same or different caliber (e.g.—20, 25, 40 mm) grenades machine gun or even combinations of such weapons.

RCWS 410 includes in addition, rotatable turret assembly 450. Mounting bracket assembly 430 is mounted on rotatable turret assembly 450 in a manner that enables elevating/lowering of weapon 440 around elevating/lowering axis 460.

Rotatable turret assembly 450 enables rotation (siding or bearing) of mounting bracket assembly 430 in siding (bearing) plane 470 that is located at a distance from elevating/lowering axis 460 and parallel to it. Bearing (siding) is executed around bearing (siding) axis 480 that extends in a vertical direction to bearing (siding) plane 470.

Reservoir means 490 for chained ammunition to weapon 440 is mounted on rotatable turret assembly 450 in the bearing (siding) plane 480 and at a distance from elevating/lowering axis 460. In the illustrated example, reservoir means 490 is formed as an arched bi-levels array of cells that in light of the specific weapon illustrated here (Mk44 Bushmaster) contains chains, that as said can be filled (loaded) with different types of bullets and then stored at different levels.

A skilled professional would understand that it is mentioned solely as examples, and reservoir means 490 can be formed in other and different configuration (not necessarily as an arched bi-level array) for example—as a single box or cluster of boxes. Reservoir means 490 might be a mere section of chained ammunition. Any professional would also understand that reservoir means 490 might be refilled or disposable (used only once) and changeable when empty.

Feeding mechanism 420 is implemented in RCWS 410 for routing the chained ammunition from reservoir means 490 to bullets entrance opening of weapon 440 (more exactly, shells as in the illustrated automatic cannon example).

Thus, by observing the figures and the cited texts, any professional might think that as if the RCWS 410 implements the second method as per prior art that we pointed at hereinabove in the 'Background of the Invention' chapter while referring to FIG. 3 (as per affixing reservoir means 490 to rotatable turret assembly 450 and routing chained ammunition from it towards the bullets entrance opening of weapon 440).

However, as different from prior art feeding mechanisms, in accordance with the invention, feeding mechanism 420 is not based on a flexible chute. Feeding mechanism 420 includes two assemblies 510, 520—based, each one, on a rather rigid chute (as distinguish from a flexible one).

Any professional would understand that each one of assemblies 510, 520 is formed as kind of a closed rectangular profile (for example—made of tin sheet or composite materials), with arched configurations and slight inclines, in order to facilitate routing the ammunition chains in it while exploiting the inherent flexibility of regular chains.

In accordance with the invention, the first chute assembly 510 serves for routing the chained ammunition from reservoir means 490 to the elevating/lowering axis region (and preferably accurately to it). Chute 510 assembly is mounted on rotatable turret assembly 450 (directly or indirectly—by affixing to reservoir means 490). Second chute assembly 520 serves to continue routing chained ammunition from elevating/lowering axis region 460 to bullets (shells) entrance opening in weapon 440. Second chute assembly 520 is mounted on mounting bracket assembly 430.

A skilled professional would understand that in the illustrated example, assemblies 510, 520 are formed, each, as a bi-level array of two rigid chutes, that in consideration of the specific weapon (Mk44 Bushmaster) are routing chains that as said, can be loaded with different shells and then routed separately in the different levels.

A skilled professional would understand that it is spoken solely of an example, that derive from the double feeding capabilities of the specific weapon that was illustrated as an example only, and assemblies 510, 520 might be formed in different and other configurations (not necessarily as bi-level array) for example—as two portions of a singular chute (as required for feeding a machine gun, automatic cannon or grenades machine guns).

A skilled professional would also understand that assemblies 510, 520; and reservoir means 490 might be formed with means for facilitating the sliding of the chain in them (for example—silicone strips) and openings that can be exploited for cleaning purposes, maintenance and releasing stoppages if occurred (see for example opening 19 and covers 612, 614).

A skilled professional would also understand that for facilitating the conveying of the chained ammunition from reservoir means 490 towards bullets (or shells) entrance opening of weapon 440, assemblies 510, 520 can be suited for operating of propelling means along their length in a manner that it would force the chain to move towards the bullets (shells) entrance opening of the weapon. Thus for example, in the illustrated example in the opening existing in assembly 510, between its two levels, towards their arrival to the elevating/lowering axis region 460, a ratcheting mechanism is mounted for pushing the chains upwards.

A skilled professional would also understand that assembly 520 can be formed in a manner that it would pass through the bearing means of the elevating/lowering axis, in parallel or to the side of the elevating/lowering axis' on its way towards the bullets (shells) entrance opening of the weapon.

Figure 7:
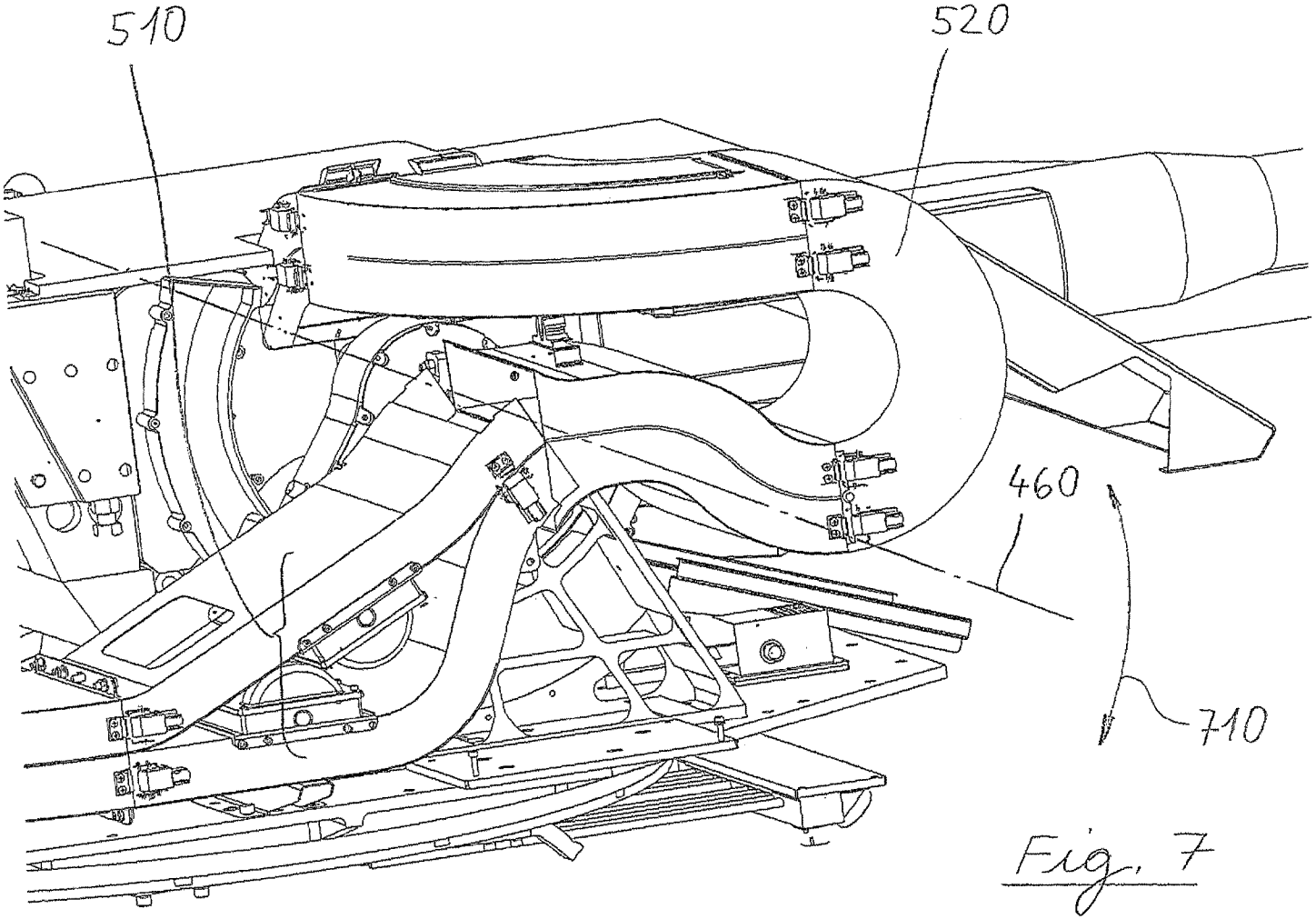
FIG. 7 is a close view in perspective of the elevating/lowering region of the RCWS shown in FIGS. 4 to 6 in which, in accordance with the invention, the chained ammunition passes over from the first chute to the second chute while the ammunition is directed in an orientation that is at least substantially matching the elevating/lowering axis direction.
Figure 8:
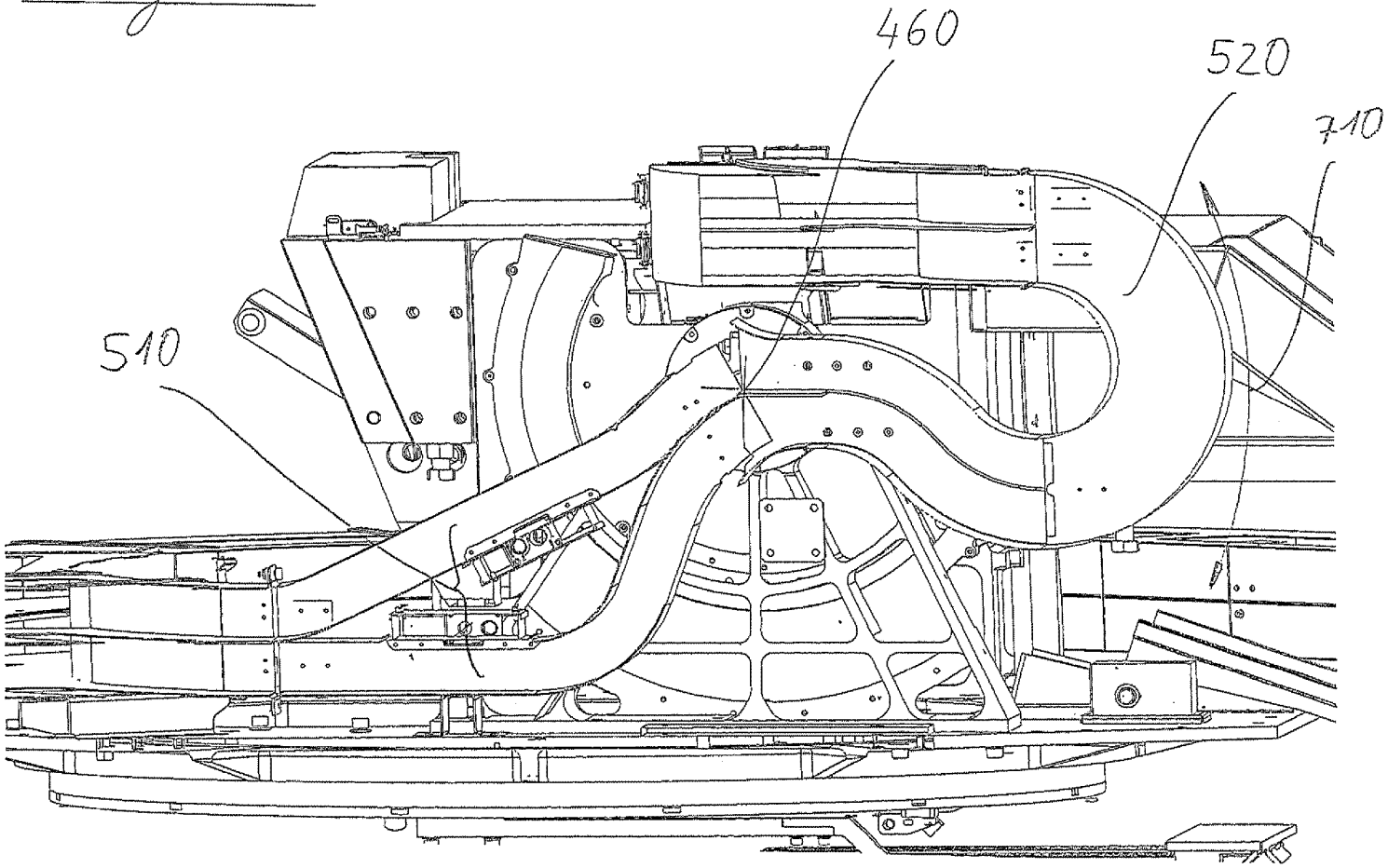
FIG. 8 is a side view of the a-a cross section that was marked in FIG. 7.

Reference is being made to FIGS. 7 and 8. FIG. 7 is a close view in perspective of the region of elevating/lowering axis 460 of RCWS 410, a region in which in accordance with the invention—the chained ammunition passes at its passing over from the first chute assembly 510 to the second chute assembly 520. FIG. 8 is a side view of the cross section that was marked a-a in FIG. 7.

As was explained above, when referring to FIGS. 4 to 6, the passage of the chained ammunition as it passes from first chute assembly 510 to second chute assembly 520, occurs at the region of elevating/lowering axis 460 and it is preferable that it would be occurring accurately along the axis length (when the chain crosses the axis on its passage between the two assemblies).

Furthermore in accordance with the invention, the chained ammunition traversing over the region of elevating/lowering axis 460, in its passing from first chute assembly 510 to second chute assembly 520, occurs when the ammunition (that is not illustrated) is oriented in a direction that is at least substantially matching the direction of elevating/lowering axis 460, namely—the traversing and the passing occur when the bullets (or shells), as a result of advanced forming of the chutes assemblies, are directed unto a length wise orientation—horizontal—wherein they extend at the direction of axis 460 (and at most deviate from the direction of the elevating/lowering axis, within the allowed inherent horizontal straddle value of the chain's links).

In accordance with the invention, and in view of implementing the various different chute assemblies, as said, one affixed to the rotatable turret assembly and the other affixed to the mounting bracket, then at a time when the mounting bracket assembly 430 is driven to elevating/lowering movement (see arrow 710) around elevating/lowering axis 460, the first chute assembly 510 remains static and the second chute assembly 520 is dynamic and propelled with the mounting bracket around the elevating/lowering axis.

In view of the butt joint between the end of assembly 510 with and in immediate proximity to the beginning of assembly 520, then in the region of the elevating/lowering axis, namely—in the region of the butt joint between the end of assembly 510 and the beginning of assembly 520, the angular movement of the beginning of assembly 520 that is taking place is minimal from its arch length aspect. It is also possible to form the beginning of the touching opening wherein the beginning of assembly 520 overlaps the end of assembly 510 and is formed as a kind of an entrance funnel (see the illustrated figure). In addition or alternatively, it is possible to cover the touching opening with a flexible cover (for example—accordion-like).

A skilled professional would understand that in view of the relative position of the passing area (in the region of the elevating/lowering axis and preferably exactly over it), and in light of the length-wise orientation as said, with the elevating/lowering axis direction, in which the bullets (shell) are found at that time, then—even when an elevating/lowering activity of the weapon occurs while firing is still done, still—the traction on the chain is relatively small and is summarized in essence in pulling/pressing that are occurring in an angular range that is relatively small and in a tendency of folding or length-wise linearly pushing in the direction of the chain. A traction that a regular chain can absolutely withstand.

In other words, splitting the chute into two separated chutes assemblies in the region of the elevating/lowering axis, wherein the first is affixed to the ammunition reservoir and remains static when elevating/lowering activity is occurring, while the second one is connected to the weapon and swings with it in accordance with the elevating/lowering movement, and concurrently directing the bullets (shells) such that they would traverse the splitting region wherein they extend in a length-wise orientation along the elevating/lowering axis (or at most at its immediate vicinity), enables exposing the chain to solely folding, without being forced to become shorter/longer.

Moreover, in view of the description given above while referring to the accompanying figures, a professional would appreciate the fact that in RCWS 410 is actually embedded also a general method for feeding chained ammunition in RCWS, to any type of weapon whatsoever that needs to be fed by chained ammunition as said. This general method is implementable in any RCWS whatever that has capability of rotating (bearing) around an axis that is vertical in its direction to the rotation (bearing or siding plane), and has a elevating/lowering capability of the weapon around an elevating/lowering axis that extends in parallel to the rotation (bearing or siding) plane and is located at a distance from it.

Figure 1:
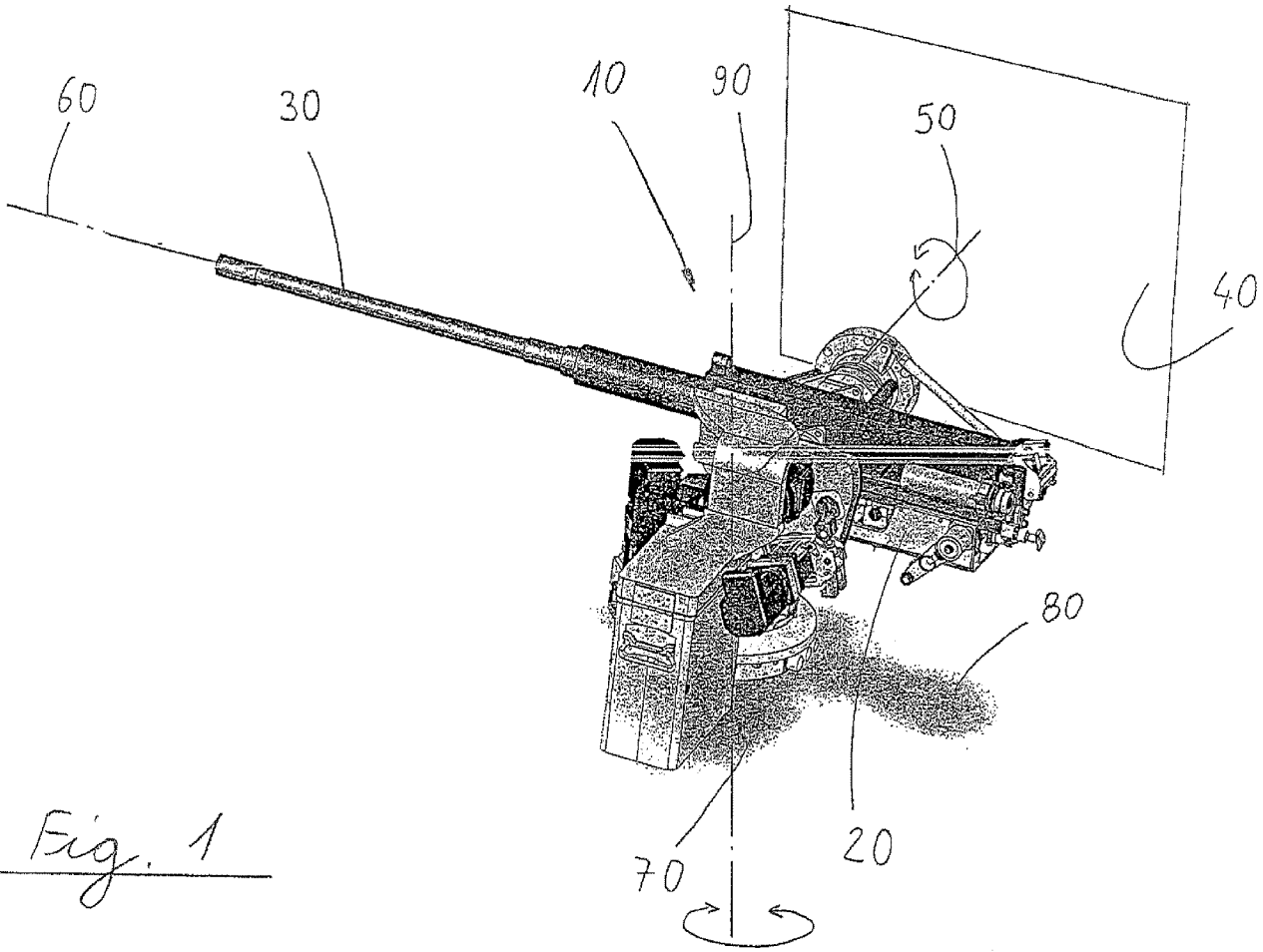
FIG. 1 is as said a representative example showing in perspective a RCWS in a manner that enables to learn the relative movements existing between its various assemblies.
Figure 2:
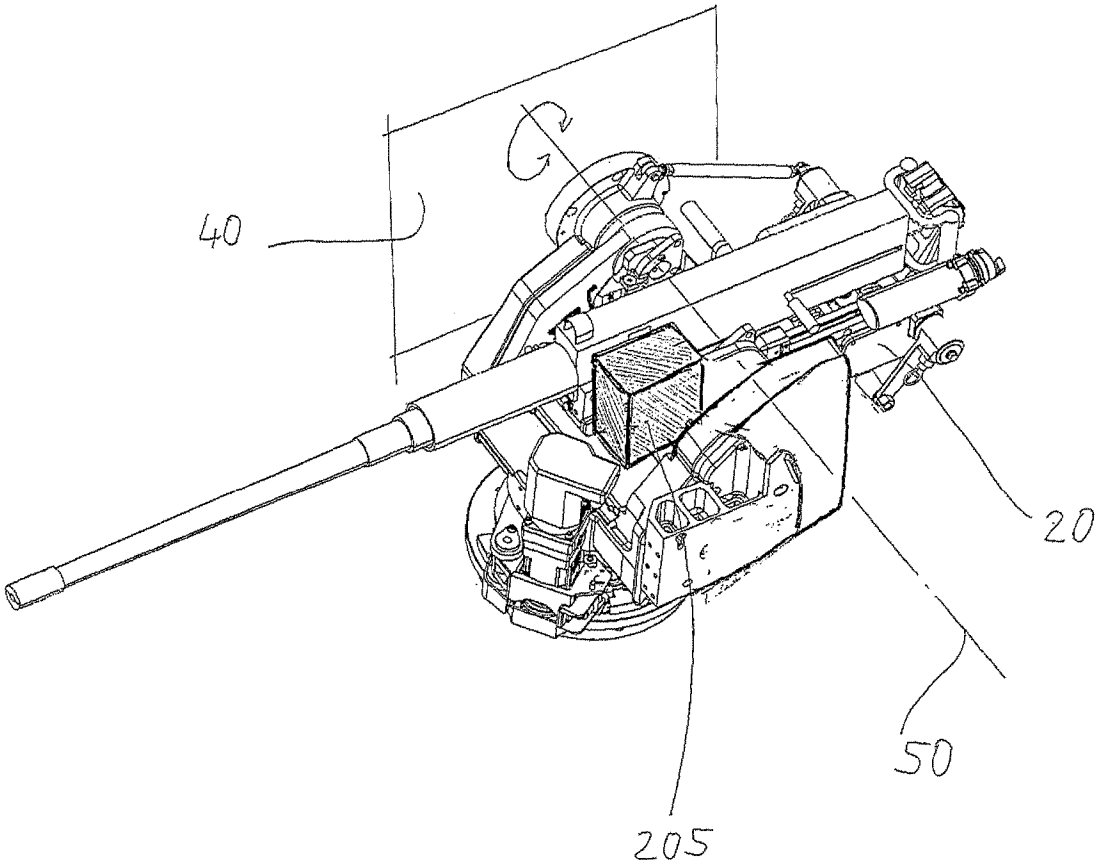
FIG. 2 is as said a schematic view in perspective of an RCWS wherein feeding its chained ammunition is executed as per the prior art of affixing the ammunition box unto the weapon mounting bracket and dynamically moving it with it.
Figure 3:
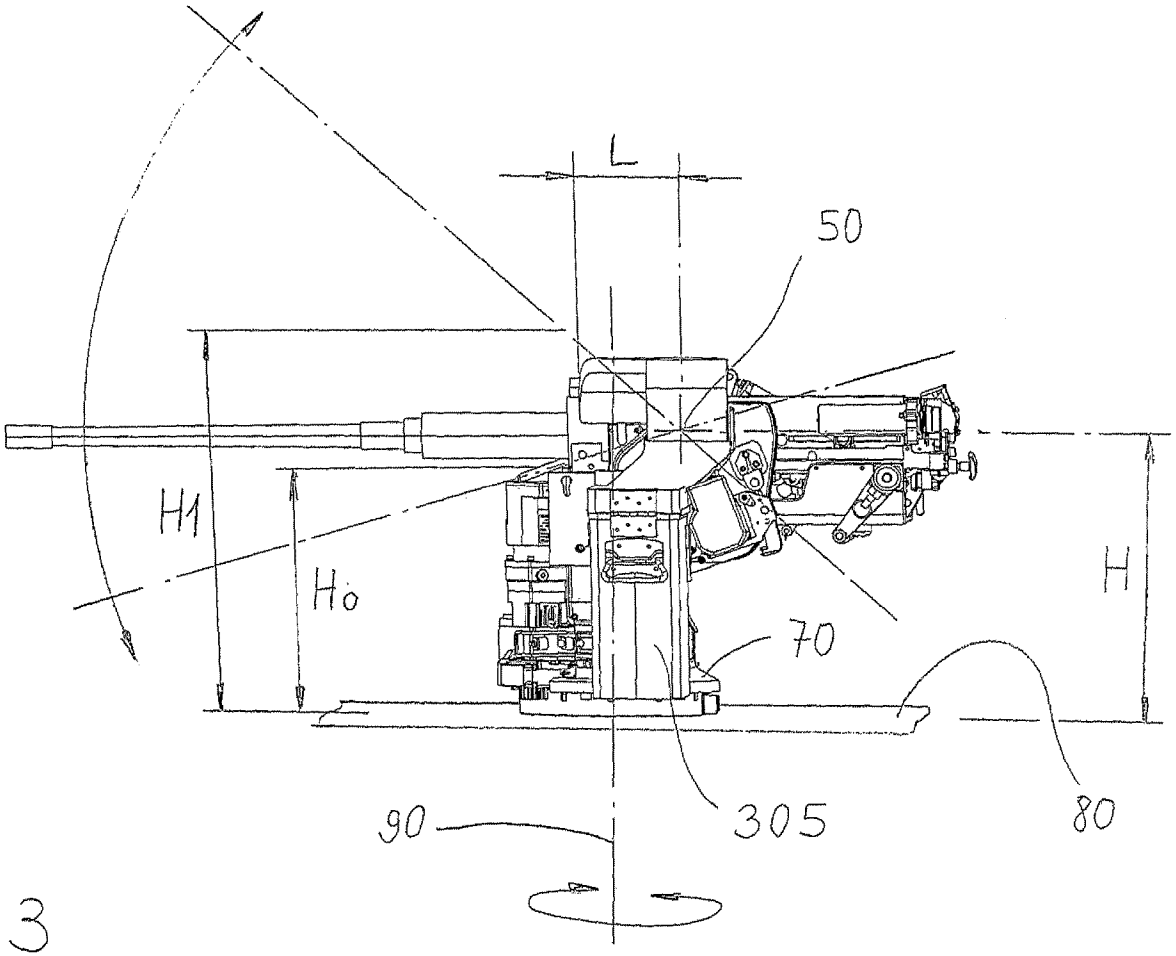
FIG. 3 is as said a schematic view in perspective of an RCWS wherein feeding its chained ammunition is executed as per the prior art of affixing the ammunition box unto the rotatable turret assembly and routing the chain from it unto the bullets entrance opening of the weapon (in the illustrated example—by resorting to use a feeding mechanism of the flexible chute type).

A method that (in accordance with the second method that we pointed at in the 'Background of the Invention' section while referring to FIG. 3) regularly comprises the step of pulling chained ammunition from an ammunition reservoir that is mounted on the rotation (bearing or siding) plane and routing it towards the bullets entrance opening of the weapon, but in accordance with the invention, continues and is characterized in that during the pulling of the chained ammunition, the method comprises the steps of— a. Routing the chained ammunition towards the region of the elevating/lowering axis using a first chute assembly.
b. Routing the chained ammunition from the region of the elevating/lowering axis towards the bullets entrance opening of the weapon.
c. Directing the ammunition in an orientation that is at least substantially matched to the direction of the elevating/lowering axis, at the time that the chained ammunition is traversing over the region of the elevating/lowering axis, while passing from a first chute assembly to the second chute assembly.

These steps, the implementation of which as part of the feeding method of weapons in RCWS, enable elevating/lowering of the weapon while firing is being executed, in a movement around the elevating/lowering axis jointly with the second chute assembly, while the first chute assembly remains static.

A professional would also understand that that it is possible to convert and suit (adapt) existing RCWS units to feeding chained ammunition in accordance with the method, by providing a kit of a feeding mechanism in accordance with the invention. The Kit of the mechanism assemblies that would be mountable in add-on configuration to existing RCWS, for routing chained ammunition from a chained ammunition reservoir that is mountable on the rotatable turret assembly of an existing RCWS, towards the bullets entrance opening of the weapon that is mountable on the mounting bracket of the existing RCWS units.

Thus, the invention provides in the RCWS field, a reliable and relatively low priced solution (as an outcome from using rigid assemblies as differentiated from a flexible chute), to the challenge of feeding chained ammunition unto the bullets entrance opening of a weapon that is mounted on a mounting bracket of an RCWS, and this without sacrificing the advantages of a relatively large volume of ammunition reservoir, and absence of a need for a dynamic balance of the mounting bracket as depending on the emptying of the ammunition reservoir. The invention enables the feeding of a large amount of chained ammunition without having to use a complex and expensive flexible chute assembly and reduces the traction of the chain to become longer/shorter (and as a consequence—also reduces the danger of ammunition surpluses that are liable to cause stoppages).

While the above description contains many specifications, the professional reader should not construe these as limitations on the scope of the RCWS which is the subject matter of the invention, but merely examples of embodiments thereof. It will be apparent to those skilled in the art of designing and manufacturing RCWS that various modification and variations can be made in the RCWS of the present invention without departing from the spirit or scope of the invention. Thus, it is intended that the present invention cover modifications and variations that come under the scope of the following claims and their equivalents.

The invention claimed is:

1. A Remote Controlled Weapon Station (RCWS) comprising:

a mounting bracket suited to have mounted thereon a weapon that is fed by chained ammunition, wherein said weapon is an automatic cannon with dual feed capability from two chains that are routed in parallel towards a bullets entrance opening;

a rotatable turret assembly wherein said mounting bracket is mounted thereon in a manner that enables elevating/lowering said weapon around an elevating/lowering axis;

said rotatable turret assembly enables rotation (bearing or siding) of said mounting bracket assembly in a bearing (siding) plane parallel to and located at a distance from the elevating/lowering axis and around a rotation (bearing or siding) axis that extends in an vertical direction to said bearing plane;

an ammunition reservoir means for chained ammunition to said weapon that is mounted on said rotatable turret assembly in said bearing (siding) plane and at a distance from said elevating/lowering axis, wherein said ammunition reservoir means is formed as a bi-level arched array of cells that contain chains that can be loaded by different kinds of shells and then stored in different levels; and a feeding mechanism for routing chained ammunition from said ammunition reservoir means towards the bullets entrance opening of said weapon;

wherein said RCWS is characterized in that said feeding mechanism comprises:

a first chute assembly for routing chained ammunition from said ammunition reservoir means towards the region of said elevating/lowering axis, wherein said first chute assembly is mounted on said rotatable turret assembly; and a second chute assembly for continuing routing said chained ammunition from the region of said elevating/lowering axis towards an entry opening of the bullets entrance of the weapon, wherein the second chute is mounted on said mounting bracket, wherein each of said first and second chutes comprises a bi-level array of rigid chutes that can route in parallel chains that can be loaded with different shells and routed separately in the different levels; and wherein— the chained ammunition traversing over said elevating/lowering axis region while passing from the first chute assembly to the second chute assembly happens when said ammunition is directed in an orientation adapting to the movement of said elevating/lowering axis; and at the time that said mounting bracket assembly is propelled to elevating/lowering motion around said elevating/lowering axis, the first chute assembly remains static and the second chute assembly is dynamic and propelled together with said mounting bracket assembly around said elevating/lowering axis.

2. A feeding mechanism that is mountable in a Remote Controlled Weapon Station (RCWS) for routing chained ammunition from reservoir means for chained ammunition that is mountable on a rotatable turret assembly of an RCWS towards a bullets entrance opening of a weapon that is mountable on a mounting bracket of the RCWS, wherein the feeding mechanism comprises:

a first chute assembly for routing the chained ammunition from the ammunition reservoir means towards the region of the mounting bracket elevating/lowering axis, wherein said first chute assembly is mountable on said rotatable turret assembly, wherein said weapon is an automatic cannon with dual feed capability from two chains that are routed in parallel towards the bullets entrance opening, and wherein said reservoir means is formed as a bi-level arched array of cells that contain chains that can be loaded by different kinds of shells and then stored in different levels; and a second chute assembly for continuing routing the chained ammunition from the elevating/lowering axis region towards the bullets entrance opening of the weapon, wherein said second chute assembly is mountable on said mounting bracket, wherein each of said first and second chutes comprises a bi-level array of rigid chutes that can route in parallel chains that can be loaded with different shells and routed separately in the different levels; and wherein upon implementing the feeding mechanism in an RCWS— the chained ammunition traversing over said elevating/lowering axis region while passing from said first chute assembly to said second chute assembly happens when said ammunition is directed in an orientation adapting to the movement of said elevating/lowering axis; and at the time that said mounting bracket assembly will be propelled to elevating/lowering motion around said elevating/lowering axis, said first chute assembly will remain static and said second chute assembly will be dynamic and move together with said mounting bracket assembly around said elevating/lowering axis.

* * * * *